United States Patent [19]

Funahashi

[11] Patent Number: 4,604,615

[45] Date of Patent: Aug. 5, 1986

[54] IMAGE REPRODUCTION INTERFACE

[75] Inventor: Yasuhiro Funahashi, Nagoya, Japan

[73] Assignee: Brother Kogyo Kabushiki Kaisha, Nagoya, Japan

[21] Appl. No.: 546,424

[22] Filed: Oct. 28, 1983

[30] Foreign Application Priority Data

Nov. 6, 1982 [JP] Japan ..... 57-195055

[51] Int. Cl.[4] ..... G09G 1/24

[52] U.S. Cl. ..... 340/750; 340/798; 340/799

[58] Field of Search ..... 340/750, 798, 799, 748, 340/749

[56] References Cited

U.S. PATENT DOCUMENTS

| | | | |
|---|---|---|---|
| 4,379,293 | 4/1983 | Boisvert et al. | 340/798 |
| 4,388,621 | 6/1983 | Komatsu et al. | 340/798 |
| 4,482,979 | 11/1984 | May | 340/750 |
| 4,485,378 | 11/1984 | Matsui et al. | 340/798 |
| 4,511,965 | 4/1985 | Najaram | 340/750 |

*Primary Examiner*—Gerald L. Brigance
*Attorney, Agent, or Firm*—Browdy and Neimark

[57] ABSTRACT

An image reproduction interface disposed between a CPU, and a display device for reproducing an image based on code signals from the CPU corresponding to multiple image elements. The interface comprises a random-access memory for temporarily storing the code signals, and a multiplexor for selecting, for a first period, an address bus for the CPU to address the memory for storing therein the code signals, and for a second period, a refresh address bus for a controller of the display device to address the memory for reading out therefrom the code signals to reproduce the image. A sum of said first and second periods is equal to an interval at which the image elements are reproduced, whereby both storage and retrieval of the code signals into and from the memory may be effected within each reproduction interval in a time-sharing manner, thus reducing an idle or waiting time of the CPU and increasing a rate of updating the image on the display device.

4 Claims, 5 Drawing Figures

CRT
20
PARA/SERI CONVERTER
58
CHARACTER GENERATOR
56
LN
DATA LATCH
48
LD1
54
3-STATE LATCH
52
62
LD2
VIDEO RAM
14
W/R
3-STATE GATE
50
CK2
LD1
EN
MULTI-PLEXOR
40
P1
P2
PS
CS
VWR
GT
LH
46
22
24
60
68
EN
TIMING SIGNAL GENERATOR
66
CKD
44
42
CRT CONTROLLER
CK2
VCS
26
WAIT CIRCUIT
18
STANDARD SIGNAL GENERATOR
64
16
DECODER
28
WR
WAIT
RD
CK1
12
STANDARD SIGNAL GENERATOR
10
CPU

IMAGE REPRODUCTION INTERFACE

BACKGROUND OF THE INVENTION

The present invention relates to an image reproduction interface which is disposed between a display device and a central processing unit (hereinafter abbreviated as CPU) producing a multiplicity of code signals corresponding to image elements, for transferring the code signal from the CPU to the display device.

An interface known in the art for use in connection with a display device for image reproduction is commonly provided with a video storage in the form of a random-access memory for temporarily storing code signals which are generated from a central processing unit and represent respective multiple image elements to be reproduced on the display device. The stored code signals are successively fed to the display device in a predetermined order, so that an image consisting of multiple image elements corresponding to the code signals stored in the random-access video memory are viewed on the screen of the display device. More specifically, each group of individual code signals corresponding to an image on one screen or a line of image elements are read out in sequence from the random-access memory at a predetermined rate, i.e., at a predetermined interval at which the individual image elements are reproduced. Therefore, it is commonly practiced that the storage or writing of the code signals into the video memory is effected during blanking periods of the display device so that the storage period (write time) will not overlap with the read-out period (read time). In a case where the display device is a cathode-ray tube (CRT), for example, the blanking time is a portion of each retrace interval of vertical or horizontal scanning signals, during which portion an electron beam of the CRT is cut off and no image reproduction takes place.

In such an arrangement, however, the read time during which the code signals are called for from the video memory is generally so adapted to be considerably longer than the blanking time. In a cathode-ray tube, for example, the read time for feeding the code signals from the video memory to the CRT is usually about five times as long as the blanking time. Accordingly, the writing time of the CPU for storage of the code signals in the memory is limited, whereby the CPU has to spend a lot of time in transferring to the memory a large number of code signals which have been stored in the CPU to reproduce an entire image on the next screen, e.g., full text of the next page of a document. This will obviously result in decrease in the rate of image reproduction.

To eliminate or alleviate the above indicated drawbacks experienced in the art, it has been proposed to allow the CPU to write or store the code signals into the random-access video memory prior to the delivery of the stored information from the video memory to the display device. In this instance wherein the priority is given to the storage operation, however, the delivery of the code signals to the display device is interrupted, and as a result the display screen will flicker. As an alternative solution to the above problem, it has also been attempted to adopt a multi-processor system wherein another processing unit is used to serve as a control unit exclusively for the display device. While this solution is successful in maintaining a sufficiently high image reproduction rate and preventing the flickering phenomenon of the screen image, it requires a complicated control arrangement.

SUMMARY OF THE INVENTION

It is accordingly an object of the present invention, which was developed in view of the above background, to provide an image reproduction interface disposed between a central processing unit and a display device, which is simple in arrangement and capable of high-speed image reproduction on the display device without flickering of the display screen.

To attain the above object, there is provided according to the invention an image reproduction interface which is disposed between a central processing unit, and a display device having a control unit and a screen on which an image is reproduced. The image reproduction interface comprises: (a) a video random-access memory for temporarily storing code signals corresponding to respective ones of a multiplicity of image elements available for reproduction on the display device; (b) a multiplexor for alternately selecting, for a first time period, an address bus through which first address signals are transferred from said central processing unit to the video random-access memory to designate memory locations at which the code signals are stored, and for a second time period, a refresh address bus through which second address signals are transferred from the control unit of the display device to the video random-access memory to sequentially designate the memory locations from which the code signals are read out to reproduce the image on the display device, a sum of the first and second time periods being equal to a reproduction interval at which the image elements are sequentially reproduced; (c) latch means, operative during the second time interval, for reading out from the video random-access memory one of the code signals which has been stored in the memory location designated by the second address signal transferred through the refresh address bus, and transferring the read-out code signal to the display device after latching the read-out code signal for a period of the reproduction interval; and (d) gate means, operative during the first time period, for permitting the code signal from the central processing unit to be stored in the video random-access memory, and temporarily storing the code signal in the memory location designated by the first address signal transferred through the address bus.

In the image reproduction interface constructed as described above, each of the reproduction intervals is divided into two time periods. One period is used for reading out the code signals from the random-access memory into the latch means, and the latched code signals are fed to the display device at the predetermined reproduction interval. Thus, the delivery of the code signals from the random-access memory to the display device is achieved at such sufficiently high rate as is commonly available in the art. This prevents possible interruption of delivery of the code signals from the memory to the display device or decrease in the reproduction rate as previously discussed, thereby assuring a high quality of images reproduced on the display. In the meantime, the remaining period of each reproduction interval is used by the CPU to store the code signals into the random-access memory through the gate means. Thus, both the storage and delivery of the code signals in and from the video memory are conducted within each one of the image reproduction cycles. This arrangement removes the conventional limitation that the storage or write time is limited to the blanking periods of the display device, and therefore eliminates a waiting time of the CPU before starting the writing operation, thus permitting a fast and smooth updating of the screen image according to the currently stored code signals. A further advantage of the instant interface lies in its elimination of a need to provide an exclusive CPU as a control unit of the display device, and consequent simplification of the control circuit arrangement.

In accordance with one advantageous aspect of the invention, the image reproduction interface may further comprise, in addition to the elements (a) through (d) recited above, (e) wait-signal generating means for generating a wait-signal, and the central processing unit is adapted to generate a first command signal to enable the code signal to be stored in the random-access memory through the gate means during an access-ready time which is a portion of the first time period of the reproduction interval. During the access-ready interval, the random-access memory is accessible for storage of the code signal. The wait-signal serves to hold the first command signal active for a length of time sufficient to overlap with an entire length of the access-ready time.

The above aspect of the invention is useful when the CPU is so high in its operating speed that an active period of a "write" signal (first command signal) for storage of the code signal may not overlap with an entire length of the access-ready time of the first time period during which the address bus is selected. In such instance, the wait-signal functions to hold the "write" signal (first command signal) active for a sufficient time so that the active time span of the "write" signal is able to overlap with the entire span of the access-ready time. This extension of the active time span of the first command signal enables the CPU to store the code signals into the video memory without otherwise possible writing failure due to insufficient overlapping of the "write" and "access-ready" signals.

In accordance with another advantageous aspect of the invention, the image reproduction interface may comprise, in addition to the elements (a) through (d) previously recited, (f) another latch means which is operative during the first time period for reading out from the video memory one of the code signals which has been stored in the memory location designated by the first address signal transferred through the address bus, and transferring the read-out code signal to the central processing unit after latching the read-out code signal for a predetermined length of time. The gate means and this other latch means are selectively rendered operative respectively by first and second command signals ("write" and "read" signals) produced from the central processing unit to store and read out the code signals in and from the video random-access memory, respectively.

In the above arrangement, the reading-out of the code signals from the video memory back to the CPU is carried out through another latch means at the reproduction interval, whereby no flickering or other troubles leading to degraded image quality will be encountered as in a scrolling operation or the like which requires the stored code signals to be fed back to the CPU.

According to a further aspect of the invention, the image reproduction interface may comprises both (e) wait-signal generating means and (f) another latch means in addition to the elements (a) through (d) previously indicated. In this instance, the wait-signal serves to hold each of the first and second command ("write" and "read") signals so that the first or second command signal overlaps with the entire length of the access-ready time. The gate means and the other latch means are selectively rendered operative by the first and second command signals, respectively.

With the above arrangement, the storage of the code signals into the video memory or the delivery of the stored code signals to the CPU may be accomplished within each reproduction interval, i.e., in synchronization with the image reproduction on the display device. Therefore, the image reproduction including a scrolling operation can be achieved at a higher rate without degrading the image quality.

While the code signals have been stated above so as to correspond to the individual image elements, each of these elements may represent one of characters including, letters, digits, symbols, and segments of a graphic figure.

BRIEF DESCRIPTION OF THE DRAWINGS

The above and other objects, features and advantages of the present invention will become more apparent from reading the following description of the preferred embodiments taken in connection with the accompanying drawings in which.

DETAILED DESCRIPTION OF THE PREFERRED EMBODIMENTS

Figure 1:
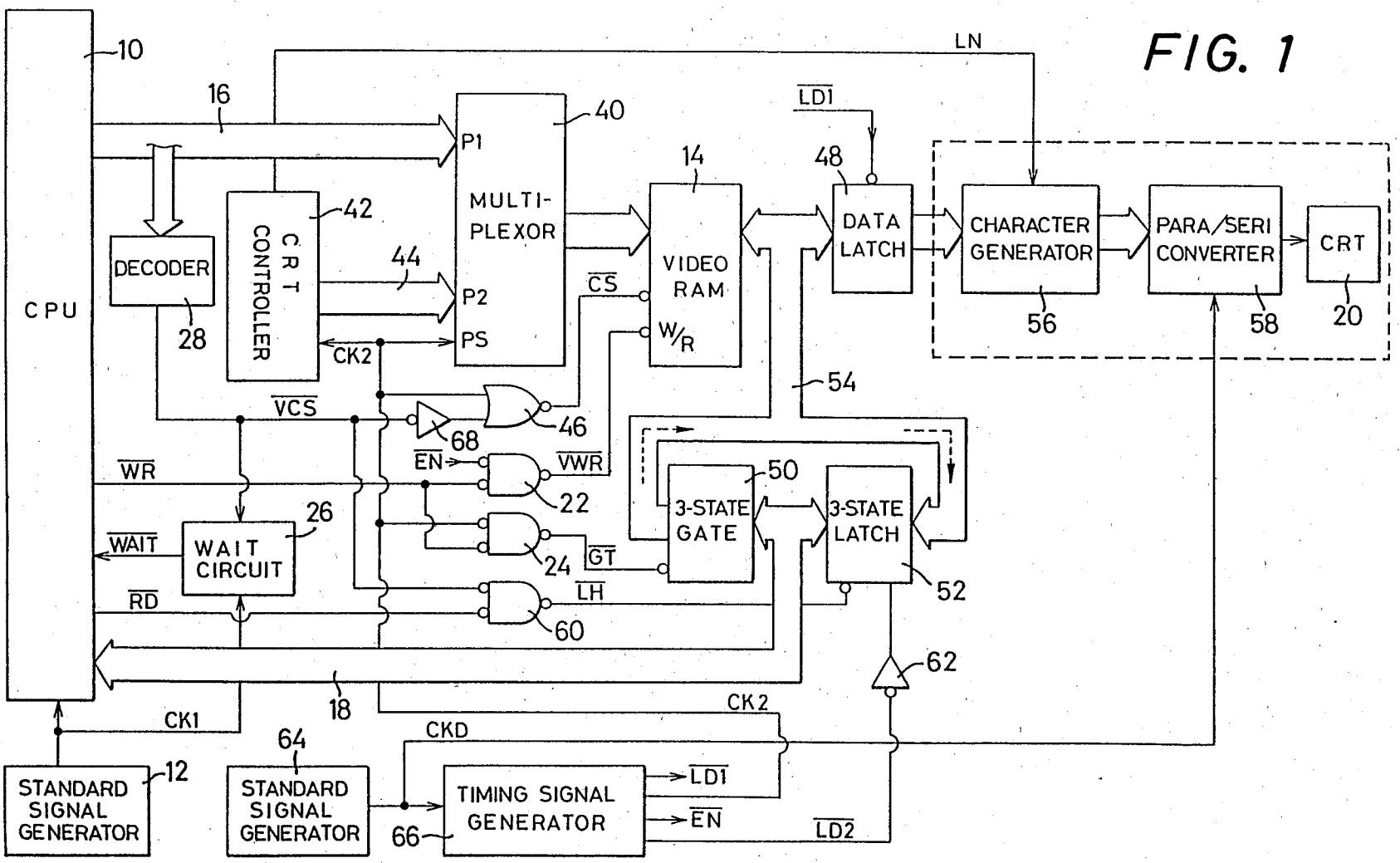
FIG. 1 is a schematic block diagram illustrating one embodiment of an image reproduction interface of the present invention.

Referring first to FIG. 1, there is shown an arrangement of an image reproduction interface disposed between a CPU 10 and a display device 20. The CPU 20 performs well known operations in timed relation with CLOCK signal CK1 produced from a standard signal generator 12, and transfers to a video random-access memory 14 (hereinafter referred to as "video memory") first address signals which designate memory locations of the video memory 14 at which information in the form of code signals is stored or written. This information transfer is conducted through an address bus 16. In the meantime, the code signals are transferred to the video memory 14 through a data bus 18. These code signals correspond to respective ones of a multiplicity of image elements such as characters including letters, digits, symbols, and segments of a graphic figure or device which are available for reproduction on a screen of a display device, for example, a cathode-ray tube (CRT 20). The CPU 10 further produces a first command signal in the form of a WRITE signal $\overline{WR}$ which enables a code signal to be stored in the video memory 14 at a predetermined timing, and a second command signal in the form of a READ signal $\overline{RD}$ which enables a stored code signal to be read out from the video memory 14 also at a predetermined timing. The WRITE signal $\overline{WR}$ is fed to two OR gates 22 and 24, and the READ signal $\overline{RD}$ is fed to an OR gate 60. These WRITE and READ signals $\overline{WR}$ and $\overline{RD}$ are adapted by a WAIT signal $\overline{WAIT}$ from a wait circuit (wait-signal generating circuit) 26, such that their active length will overlap with an entire length of an access-ready time during which the video memory 14 is accessible for storage and delivery of the code signals. In other words, the WAIT signal serves to hold the WRITE and READ signals $\overline{WR}$ and $\overline{RD}$ active for a length of time sufficient to overlap with the entire access-ready time. It is noted here that a bar is placed over the reference characters of various signals when the signal is "active-low", i.e., active in its low state.

The wait circuit 26 is provided with a VIDEO MEMORY SELECT signal $\overline{VCS}$ from a decoder 28. The signal $\overline{VCS}$ indicates the recognition by the decoder 28 that any one of addresses of the video memory 14 is designated by the first address signal transferred through the address bus 16. An exemplary arrangement of the wait circuit 26 is shown in FIG. 2, wherein the arrangement comprises three D-type flip-flops 30, 32 and 34.

Figure 2:
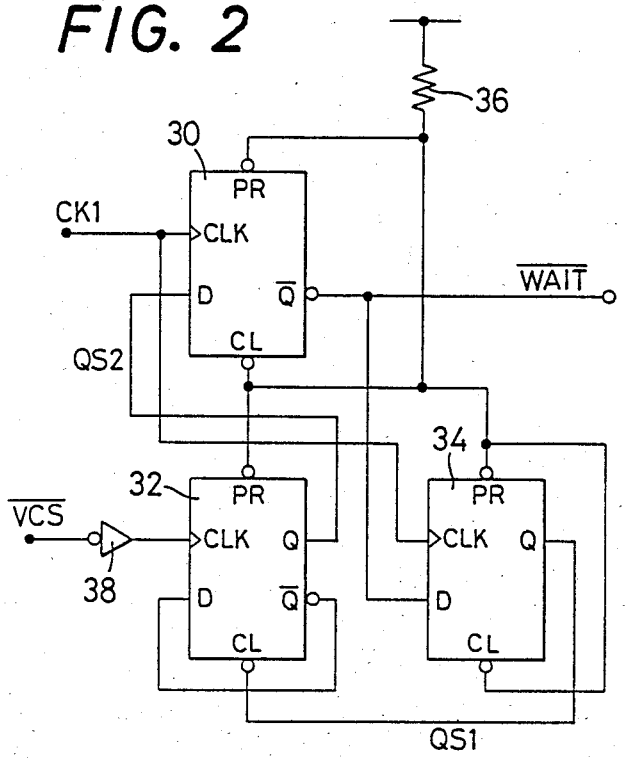
FIG. 2 is a schematic block diagram showing an arrangement of a wait-signal generating circuit.
Figure 3:
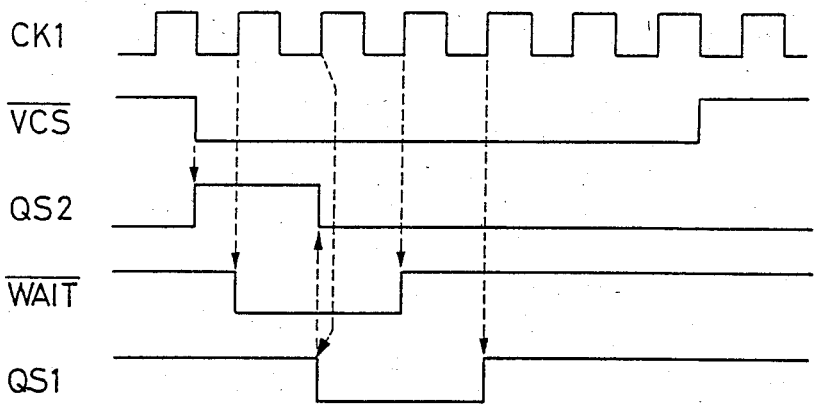
FIG. 3 is a timing chart showing an operation of the wait-signal generating circuit of FIG. 2.

As depicted in FIG. 2, terminals PR of the flip-flops 30, 32, 34 and clear terminals CL of the flip-flops 30, 34 are all held in their pull-up state in connection with a power line through a pull-up resistor 36. Clock input terminals CLK of the flip-flops 30, 34 receive the previously indicated CLOCK signal CK1, and clock input terminal CLK of the flip-flop 32 receives the VIDEO MEMORY SELECT signal $\overline{VCS}$ through an inverter 38. The WAIT signal $\overline{WAIT}$ generated from an output terminal $\overline{Q}$ of the flip-flop 30 is applied to an input terminal D of the flip-flop 34, while a signal QS1 from an output terminal $\overline{Q}$ of the flip-flop 34 is applied to a clear terminal CL of the flip-flop 32. A signal QS2 from the flip-flop 32 is applied to an input terminal D of the flip-flop 30, and a signal from an output terminal $\overline{Q}$ of the flip-flop 32 is applied to its input terminal D. The wait circuit 26 arranged as described above, is operated in the following manner as illustrated in FIG. 3. Upon falling of the VIDEO MEMORY SELECT signal $\overline{VCS}$, the flip-flop 32 is inverted and the signal QS2 is applied to the flip-flop 30. At the instant the next CLOCK signal CK1 has been generated, the flip-flop 30 is inverted and the $\overline{WAIT}$ signal WAIT is rendered active. Upon rising of the next CLOCK signal CK1, the flip-flop 34 is inverted and the flip-flop 32 is cleared by the signal QS1 from the inverted flip-flop 34, whereby the signal QS2 applied to the flip-flop 30 is cut off. As a result, the flip-flop 30 is inverted upon rising of the next CLOCK signal CK1, and the signal $\overline{WAIT}$ from the flip-flop 30 is held in its inactive state. As described above, the signal $\overline{WAIT}$ is held active for a time span equal to two pulse intervals (spacings) of the CLOCK signal CK1 after the VIDEO MEMORY SELECT signal $\overline{VCS}$ has been rendered active. The active time span of the signal $\overline{WAIT}$ is selected so that the WRITE or READ signal $\overline{WR}$ or $\overline{RD}$ from the CPU 10 is held active for a period sufficient to cover or overlap with the entire length of the access-ready time, irrespective of the timing at which such WRITE or READ signal is generated by the CPU 10.

Referring back to FIG. 1, the first address signals from the CPU 10 are fed through the address bus 16 to an input port P1 of a multiplexor 40, while second address signals from a CRT controller 42 of the display device 20 is fed through a refresh address bus 44 to an input port P2 of the multiplexor 40. The multiplexor 40 has a port PS which receives a CLOCK signal CK2 to select one of the input ports P1 and P2, so that the address signal applied to the selected input port P1 or P2 is fed to the video memory 14. The CLOCK signal CK2 is generated at an interval at which the image elements are reproduced on the CRT 20. Therefore, as described in more detail, the multiplexor 40 alternately selects, within the image reproduction interval, the first address signal from the CPU 10 and the second address signal from the CRT controller 42, and sends the selected address signal to the video memory 14. The video memory 14 is placed in its access-ready state by a CHIP SELECT signal $\overline{CS}$ from a NOR gate 46, and in its ready-to-write state by a VIDEO MEMORY WRITE signal $\overline{VWR}$ from the OR gate 22. The term "access-ready state" means a state in which the video memory 14 is ready to accept the code signal from the CPU 10 for storage thereof, or ready to deliver the stored code signal to the CPU 10.

The video memory 14 is connected to a data latch 48 (latch means), a 3-state gate 50 (gate means) and a 3-state latch 52 (another latch means) through a data bus 54. The 3-state gate 50 and the 3-state latch 52 are both connected to the CPU 10 through the previously indicated data bus 18. The data latch 48 latches the code signal from the video memory 14 for a period equal to the image reproduction interval, according to a LOAD signal $\overline{LD1}$ which is generated at the image reproduction interval. The latched code signal is then transferred to a character generator 56 which receives a LINE signal LN identifying one of plural horizontal scanning lines. The generator 56 feeds a parallel/series converter 58 with character information signals representing locations of dots on the individual scanning lines, which dots correspond to subdivisions of an image element such as a character. The character information signals are converted by the parallel/series converter 58 into series signals which are applied to the CRT 20 in synchronization with a DOT CLOCK signal CKD.

The 3-state gate 50 receives a GATE signal $\overline{GT}$ from the OR gate 24. When the GATE signal $\overline{GT}$ is not applied, the 3-state gate 50 is placed in its high-impedance state in which the data bus 18 is disconnected from the data bus 54. When the GATE signal $\overline{GT}$ is applied to the 3-state gate 50, the two data buses 18 and 54 are connected to each other, whereby the code signal transferred from the CPU 10 through the data bus 18 is allowed to be stored in the video memory 14 through the 3-state gate 50 and the data bus 54. Similarly, the 3-state latch 52 receives a LATCH signal $\overline{LH}$ from the OR gate 60. When the LATCH signal $\overline{LH}$ is not applied, the 3-state latch 52 is placed in its high-impedance state. With the LATCH signal $\overline{LH}$ being applied to the 3-state latch 52, the information latched therein is allowed to be fed back to the CPU 10 through the data bus 18. When the 3-state latch 52 receives a LOAD signal $\overline{LD2}$ fed through an inverter 62, the code signal coming from the video memory 14 through the data bus 54 is latched in the 3-state latch 52 until the next LOAD signal $\overline{LD2}$ is applied thereto.

The CLOCK signal CK2 and the LOAD signals $\overline{LD1}$, $\overline{LD2}$ referred to above, and a ACCESS-READY signal $\overline{EN}$ discussed later in detail, are produced at a predetermined timing from a timing signal generator 66 in timed relation with the DOT CLOCK signal CKD from a standard signal generator 64 which controls the image reproducing operation of the display device (CRT) 20. Described more specifically referring to a timing chart of FIG. 4, the DOT CLOCK signal CKD is generated usually at an interval T0 of several tens of nanoseconds. The CLOCK signal CK2 repeats its high- and low-level states alternately every four clock pulses of the DOT CLOCK signal CKD. That is, the CLOCK signal CK2 is held in its high-level state for a time period DD which is equal to four pulse intervals of the DOT CLOCK signal CKD, and in its low-level state for the following time period CC equal to the following four pulse intervals of the signal CKD. The time period DD is used for reading out the code signal from the video memory 14 to deliver it to the data latch 48, and the time period CC is used for storing the code signal from the CPU 10 into the video memory 14 or for reading out the code signal from the video memory 14 to deliver it to the CPU 10. Stated the other way, the period DD is used to effect an image reproduction, and the period CC is used by the CPU 10 for storing or receiving the code signal in or from the video memory 14. A sum of the two time periods DD and CC is equal to an image reproduction interval T1 at which the image elements represented by the individual code signals are sequentially reproduced on the CRT 20. Thus, it is so designed that, during each reproduction interval T1, one code signal from the CPU 10 may be stored in the video memory 14 and one stored code signal may be read out from the video memory 14. The previously introduced ACCESS-READY signal $\overline{EN}$ becomes low (active) after one pulse interval of the DOT CLOCK signal CKD after the fall of the CLOCK signal CK2. The low or active state of the ACCESS-READY signal $\overline{EN}$ is maintained for a period equal to two pulse intervals of the DOT CLOCK signal CKD. The active time span of the signal $\overline{EN}$ is referred to as "access-ready time" which is a portion of the time period CC of the CLOCK signal CK2. During the access-ready time, the ACCESS-READY signal $\overline{EN}$ permits the video memory 14 to be accessible (for reading out the code signal therefrom to send it back to the CPU 10). The LOAD signal $\overline{LD1}$ which triggers a latching operation of the data latch 48, is held active for a period of one pulse interval of the DOT CLOCK signal CKD at the end of the time period DD of the CLOCK signal CK2. The LOAD signal $\overline{LD2}$ which triggers a latching operation of the 3-state latch 52, is held active for a period of the one pulse interval of the signal CKD at the end of the period CC of the signal CK2. These LOAD signals $\overline{LD1}$ and $\overline{LD2}$ are arranged to become active at the end of the time period DD and CC in order that the code signal from the video memory 14 is latched after the output of the memory 14 has been stabilized.

The CLOCK signal CK2 which is supplied to the multiplexor 40 and the CRT controller 42, is also supplied to the NOR gate 46 and the OR gate 24. Further, the VIDEO MEMORY SELECT signal $\overline{VCS}$ is also supplied to the NOR gate 46 via the inverter 68, and to the OR gate 60. The ACCESS-READ signal $\overline{EN}$ is applied to the OR gate 22, and the WRITE signal $\overline{WR}$ is applied to the OR gates 22 and 24 while the READ signal $\overline{RD}$ is supplied to the OR gate 60. It is noted that the WRITE and READ signals $\overline{WR}$ and $\overline{RD}$ are produced in timed relation with the CLOCK signal CK1 and therefore not in synchronization with the CLOCK signal CK2. This means that the active time span of these WRITE and READ signals $\overline{WR}$ and $\overline{RD}$ may not always overlap with the entire length of the access-ready time of the ACCESS-READY signal $\overline{EN}$, as illustrated in broken line of FIG. 4. For this reason, there is provided the previously discussed WAIT signal $\overline{WAIT}$ which serves to extend the active time span of the signal $\overline{WR}$ and $\overline{RD}$ by a necessary length of time (indicated in the broken line) so that the active time span of the signal $\overline{WR}$ or $\overline{RD}$ overlaps with the entire length of the access-ready time of the signal $\overline{EN}$. With this arrangement, therefore, the generation of the WRITE signal $\overline{WR}$ at any timing will enable the video memory 14 to receive a VIDEO MEMORY WRITE signal $\overline{VWR}$ which has a pulse interval or spacing equal to the access-ready time or active time span of the ACCESS-READY signal $\overline{EN}$, thereby assuring a stable storage operation of a code signal from the CPU 10 into the video memory 14. Similarly, a reading operation of a code signal stored in the video memory 14 to deliver it to the CPU 10 can be stably achieved whenever the READ signal RP is generated.

The operation of the image reproduction interface arranged as described heretofore will be discussed below.

While the CLOCK signal CK2 is in its high-level state, i.e., during the time period DD of each reproduction interval T1, the input port P2 is selected by the multiplexor 40, which therefore receives the second address signal from the CRT controller 42 and transfers it to the video memory 14. The CRT controller 42 generates the second address signals, in synchronization with the CLOCK signal CK2, to designate in the predetermined reading sequence the code signals stored in the video memory 14. The designated code signal is read out from the video memory 14 and latched in the data latch 48 in synchronization with the LOAD signal $\overline{LD1}$ which becomes active at the end of each time period DD of the CLOCK signal SK2. The latched code signal is applied to the character generator 56 until the next LOAD signal $\overline{LD1}$ is presented. Upon application of this code signal, the character generator 56 feeds the parallel/series converter 58 with an appropriate character information signals which represents locations of dots on the horizontal scanning line designated by the LINE signal LN. As stated before, these dots correspond to subdivisions of an image element such as a character. The character information signal is converted by the parallel/series converter 58 into series signals which are applied to the CRT 20 in synchronization with the DOT CLOCK signal CKD.

The above operation is repeated a number of times equal to the number of the horizontal scanning lines, so that the character (including a segment of a graphic figure) represented by the code signal is reproduced on the CRT 20.

As discussed above, the delivery of the code signals from the video memory 14 to the character generator 56 is accomplished at the reproduction interval T1, that is, at such reproduction rate (as achieved in the art) that causes no flickering phenomenon or other troubles leading to degraded image quality.

While the CLOCK signal SK2 is in its low-level state, i.e., during the time period CC of each reproduction interval T1, the multiplexor 40 selects its input port P1 which receives the first address signal transferred from the CPU 10 through the address bus 16. When this first address signal designates any one of the addresses of the video memory 14, the VIDEO MEMORY SELECT signal $\overline{VCS}$ is applied to the NOR gate 46, which then feeds the CHIP SELECT signal $\overline{CS}$ to the video memory 14, whereby the video memory 14 is rendered accessible for storage of the code signal.

When the WRITE signal $\overline{WR}$ is produced to store a code signal in the video memory 14 for changing the image on the CRT 20, the VIDEO MEMORY WRITE signal $\overline{VWR}$ is fed to the video memory 14 during a portion of the active time span of the WRITE signal $\overline{WR}$ which overlaps with the active time span of the ACCESS-READY signal $\overline{EN}$, whereby the video memory 14 is made accessible for storage. At this instant, the CLOCK signal CK2 is in its low-level state and consequently the GATE signal $\overline{GT}$ is produced from the OR gate 24 and applied to the 3-state gate 50, so that the data buses 18 and 54 are connected to each other. As a result, the code signal presented from the CPU 10 is stored in a memory location of the video memory 14 designated by the first address signal from the CPU 10. The above operation is repeated at the reproduction interval T1, and thus the video memory 14 is loaded with the necessary code signals. The storage operation is very efficient because it is conducted concurrently with the reading of the stored code signals from the video memory 14 to transfer it to the data latch 48. This is contrary to the conventional method in which the loading of a video memory is carried out during a blanking time which is provided after a group of code signals corresponding to one screen page or one line have been delivered to display device. The blanking time is usually about one-fifth of the reading or delivery time, and therefore the storage time for loading the video memory is limited by the blanking time. This limitation is a source of reducing a rate at which the screen image is changed or updated according to the incoming code signals. In the present embodiment, however, both the storage and the delivery of the code signals are conducted concurrently. As a consequence, the screen image is changed at a considerably high rate. It is a further advantage that the concurrent writing and reading operations for such fast reproduction of images will not require a separate processing unit for controlling the CRT 20 (in addition to the CPU 20) and hence eliminate the need for adopting a multi-processor system as practiced in the art. Thus, the control arrangement is greatly simplified according to the instant invention.

There will be described next the manner in which the code signals stored in the video memory 14 are fed back to the CPU 10 for some reasons, e.g., for performing a scrolling operation.

Figure 4:
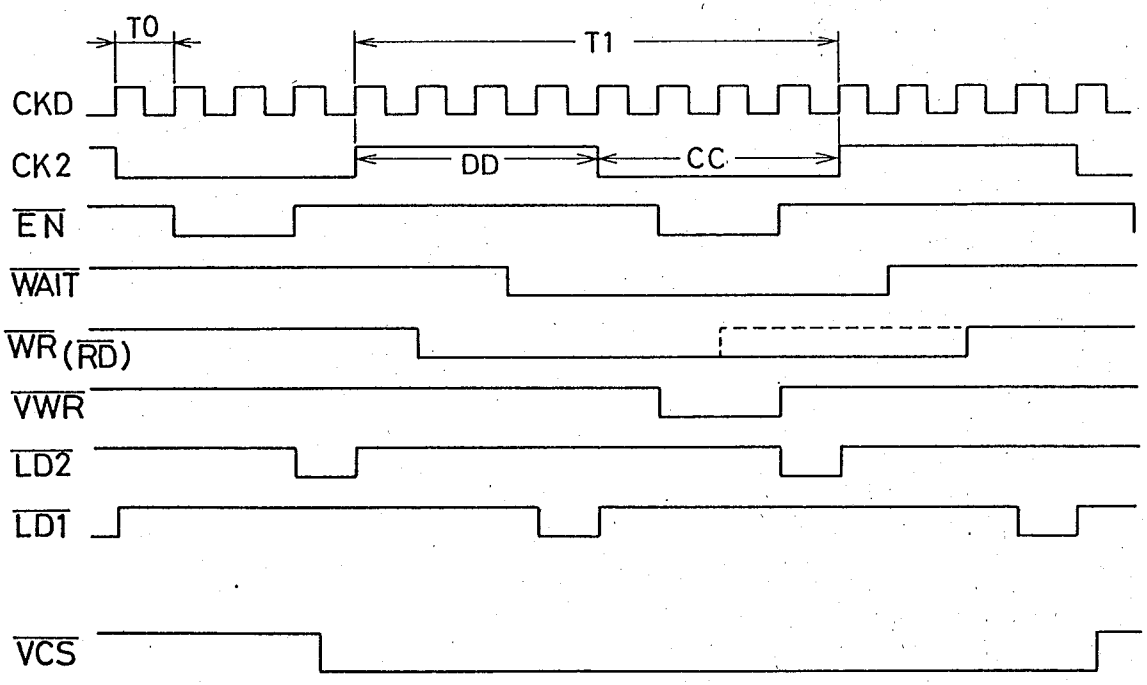
FIG. 4 is a timing chart for explaining an operation of the instant image reproduction interface of FIG. 1.

The READ signal $\overline{RD}$ is present during the time period CC of the CLOCK signal CK2. Since the VIDEO MEMORY SELECT signal $\overline{VCS}$ has been generated from the decoder 28 as shown in FIG. 4, the LATCH signal $\overline{LH}$ from the OR gate 60 is applied to the 3-state latch 52. Thus, the latch 52 delivers the information already latched therein to the CPU 10, and is set ready to accept the code signal from the video memory 14 when the LOAD signal $\overline{LD2}$ is presented. Upon generation of the LOAD signal $\overline{LD2}$ at the end of the time period CC, the stored code signal in the video memory 14 designated by the first adress signal through the address bus 16 is transferred through the data bus 54 to the 3-state latch 52. The latched code signal is delivered to the CPU 10 through the data bus 18. In this way, the delivery of the stored code signals from the video memory 14 to the CPU 10 is also conducted at each image reproduction interval T1 in synchronization with the image reproduction on the CRT 20. Unlike the conventional method wherein the blanking time is utilized for delivery of the code signals to the CPU, the instant method contributes to reduced waiting time of the CPU 10 and increased speed of scrolling and similar operations.

Figure 5:
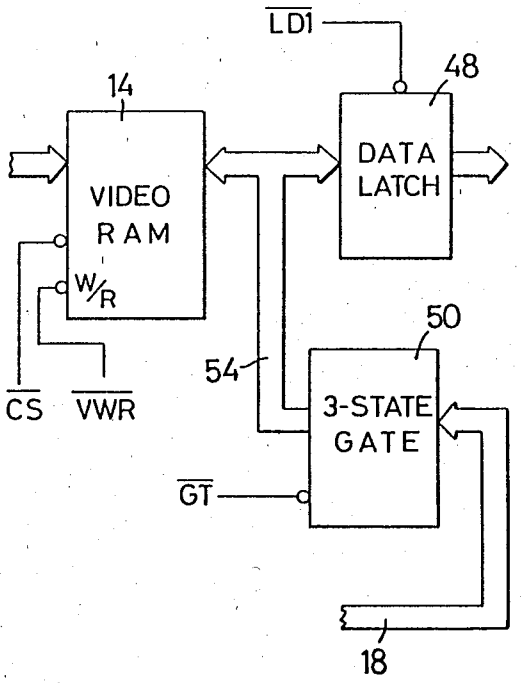
FIG. 5 is a schematic block diagram illustrating a modified embodiment of the interface of the invention.

While the wait circuit 26 is provided in the embodiment of the image reproduction interface discussed above, this circuit 26 may be eliminated when the operating speed of the CPU 10 is low enough to assure that the active time span of any WRITE or READ signal WR or RD always overlaps with the entire length of the access-ready time which is defined by the active time span of the ACCESS-READY signal $\overline{EN}$. Further, it is possible to eliminate the 3-state latch 52, OR gate 60, inverter 62, etc., as shown in FIG. 5, when there is no need to feed the code signals from the video memory 14 back to the CPU 10 for scrolling or other purposes.

It is to be understood that other changes and modifications may occur to those skilled in the art without departing from the scope of the present invention defined in the appended claims.

What is claimed is:

1. An image reproduction interface disposed between a central processing unit, and a display device having a control unit and a screen on which an image is reproduced, comprising:

a video random-access memory for temporarily storing code signals corresponding to respective ones of a multiplicity of image elements available for reproduction on said display device;

a multiplexor for alternately selecting, for a first time period, an address bus through which first address signals are transferred from said central processing unit to said video random-access memory to designate memory locations at which said code signals are stored, and for a second time period, a refresh address bus through which second address signals are transferred from said control unit of the display device to said video random-access memory to sequentially designate said memory locations from which said code signals are read out to reproduce the image on said display device, a sum of said first and second time periods being equal to a reproduction interval at which said image elements are sequentially reproduced;

latch means, operative during said second time period, for reading out from said video random-access memory one of said code signals which has been stored in the memory location designated by the second address signal transferred through said refresh address bus, and applying the read-out code signal to said display device for a period of said reproduction interval while latching said read-out code signal for the period of said reproduction interval;

gate means, operative during said first time period, for permitting the code signal from said central processing unit to be temporarily stored in the memory location of said video random-access memory designated by the first address signal transferred through said address bus;

said central processing unit generating a first command signal to enable the code signal to be stored in said video random-access memory through said gate means during an access-ready time which is a portion of said first time period and during which said video random-access memory is accessible for storage of said code signal; and wait-signal generating means for applying a wait-signal to said central processing unit, said wait-signal holding said first command signal active for a length of time sufficient to overlap with an entire length of said access-ready time.

2. An image reproduction interface as recited in claim 1, wherein each of said image elements represents one of characters including symbols, and segments of a graphic figure.

3. An image reproduction interface disposed between a central processing unit, and a display device having a control unit and a screen on which an image is reproduced, comprising:

a video random-access memory for temporarily storing code signals corresponding to respective ones of a multiplicity of image elements available for reproduction on said display device;

a multiplexor for alternately selecting, for a first time period, an address bus through which first address signals are transferred from said central processing unit to said video random-access memory to designate memory locations at which said code signals are stored, and for a second time period, a refresh address bus through which second address signals are transferred from said control unit of the display device to said video random-access memory to sequentially designate said memory locations from which said code signals are read out to reproduce the image on said display device, a sum of said first and second time periods being equal to a reproduction interval at which said image elements are sequentially reproduced;

latch means, operative during said second time period, for reading out from said video random-access memory one of said code signals which has been stored in the memory location designated by the second address signal transferred through said refresh address bus, and applying the read-out code signal to said display device for a period of said reproduction period while latching said read-out signal for the period of said reproduction interval;

gate means, operative during said first time period, for permitting the code signal from said central processing unit to be temporarily stored in the memory location of said video random-access memory designated by the first address signal transferred through said address bus;

another latch means, operative during said first time period, for reading out from said video random-access memory one of said code signals which has been stored in the memory location designated by the first address signal transferred through said address bus, and transferring the read-out code signal to said central processing unit for a predetermined length of time while latching said read-out code signal for said predetermined length of time;

said central processing unit generated a first and a second command signal which selectively render operative said gate means and said another latch means, respectively to enable the code signal to be stored in and read out from said video random-access memory through said gate means and said another latch means, respectively, during an access-ready time which is a portion of said first time period during whch said video random-access memory is accessible for storage and reading-out of said code signal; and wait-signal generating means for applying a wait-signal to said central processing unit, said wait-signal holding said first and second command signals active for a length of time sufficient to overlap with an entire length of said access-ready time.

4. An image reproduction interface as recited in claim 3, wherein the code signal from said central processing unit is transferred to said video random-access memory through a first data bus, said gate means and a second data bus, and the code signal read out from said video random-access memory being transferred to said central processing unit through said second data bus, said another latch means and said first data bus, one of said gate means and said another latch means being placed in a high-impedance state while the other of said gate means and said another latch means transfers the code signal from said central processing unit to said video random-access memory or vice versa.

* * * * *